US006979065B2

(12) United States Patent
Egger

(10) Patent No.: US 6,979,065 B2
(45) Date of Patent: Dec. 27, 2005

(54) COUPLING DEVICE FOR AN INTEGRATED DAMPER IN A PULL-OUT SLIDE SET

(75) Inventor: Remo Egger, Langenegg (AT)

(73) Assignee: Grass GmbH, Hochst/Voralberg (AT)

( * ) Notice: Subject to any disclaimer, the term of this patent is extended or adjusted under 35 U.S.C. 154(b) by 129 days.

(21) Appl. No.: 10/705,623

(22) Filed: Nov. 10, 2003

(65) Prior Publication Data

US 2004/0104650 A1 Jun. 3, 2004

(30) Foreign Application Priority Data

Nov. 29, 2002 (DE) ..... 102 56 133

(51) Int. Cl.[7] ..... A47B 88/00
(52) U.S. Cl. ..... 312/333; 312/319.1
(58) Field of Search ..... 312/330.1, 333, 312/334.6, 334.1, 334.14, 334.27, 334.29, 312/334.31, 334.34, 334.44, 319.1; 384/21

(56) References Cited

U.S. PATENT DOCUMENTS

| | | | | |
|---|---|---|---|---|
| 3,771,823 | A * | 11/1973 | Schnarr | 292/270 |
| 5,281,021 | A | 1/1994 | Rock et al. | |
| 5,364,179 | A * | 11/1994 | Brustle et al. | 312/333 |
| 5,474,375 | A * | 12/1995 | Hollenstein et al. | 312/319.1 |
| 6,340,078 | B1 * | 1/2002 | Scheible | 188/166 |
| 6,629,738 | B2 * | 10/2003 | Salice | 312/333 |
| 6,672,692 | B2 * | 1/2004 | Weng | 312/333 |
| 6,736,471 | B2 * | 5/2004 | Lin | 312/333 |
| 6,752,478 | B1 * | 6/2004 | Francz | 312/334.1 |
| 2003/0067527 | A1 | 4/2003 | Grasser | |
| 2004/0000850 | A1 * | 1/2004 | Harn et al. | 312/333 |
| 2004/0107536 | A1 * | 6/2004 | Hollenstein | 16/94 R |
| 2004/0174101 | A1 * | 9/2004 | Lin | 312/333 |

FOREIGN PATENT DOCUMENTS

| | | | |
|---|---|---|---|
| DE | 24 21 657 | * | 11/1975 |
| DE | 10214596 | A1 | 1/2003 |
| DE | 20218067 | U1 | 3/2003 |
| EP | 0841451 | A2 | 5/1998 |
| EP | 1127514 | A1 | 8/2001 |
| WO | WO 01/50917 | A1 | 7/2001 |
| WO | 2004/045339 | * | 7/2004 |

* cited by examiner

*Primary Examiner*—Janet M. Wilkens
(74) *Attorney, Agent, or Firm*—John M. Harrington; Kilpatrick Stockton LLP

(57) ABSTRACT

A coupling device for a damping element integrated in a pull-out slide set whereby both a damping device (7) and a coupling device (6) are located between the firmly fixed cabinet rail (2) and the linear-movable drawer rail (5) so that the damping device (7) has at least one cylinder (8) and in it, at least one damped linear-movable piston rod (9) and the damping device (7) is connected by one of its clamping components (8 or 9) with one of the rails (2 or 5) and by its other respective damping part (9 or 8) via the coupling device (6) with the other respective rail (5 or 2), can be coupled at times during the closing and opening of the drawer. The advantage is that less manual force is needed for pulling the movable cabinet component out. Also, it can be more easily adjusted and ensures a longer life span.

20 Claims, 6 Drawing Sheets

Fig.12
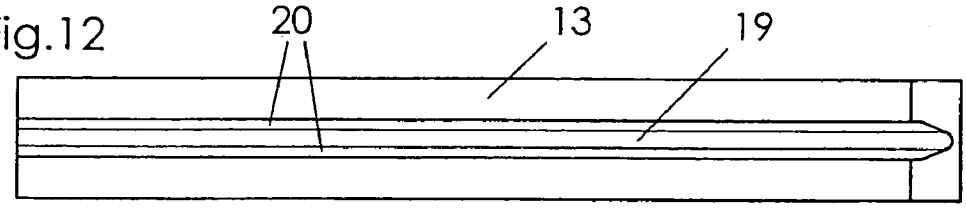
Fig.13
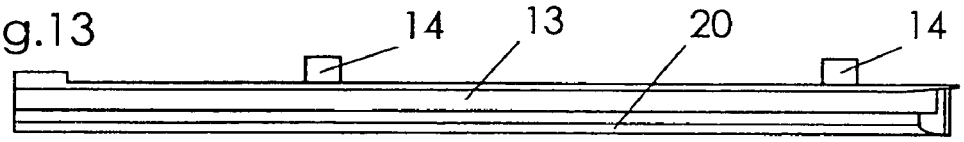
Fig.14
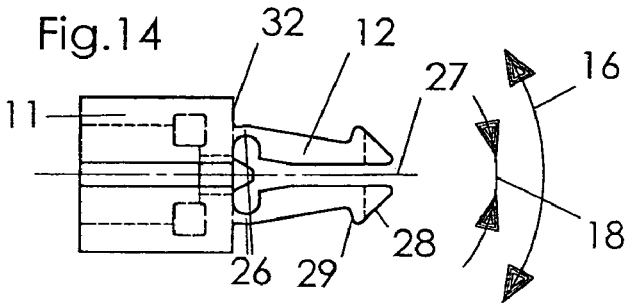
Fig.16
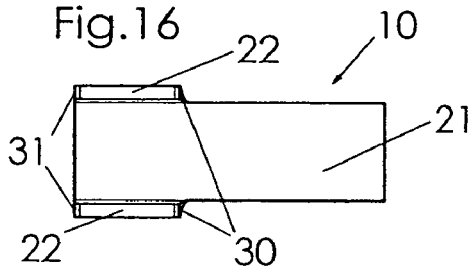
Fig.15
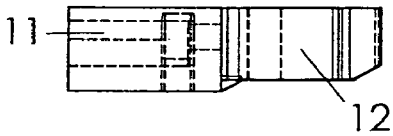
Fig.17
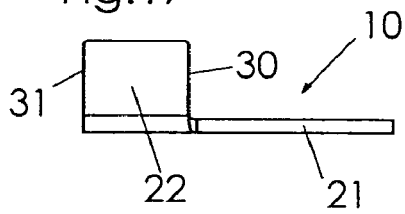
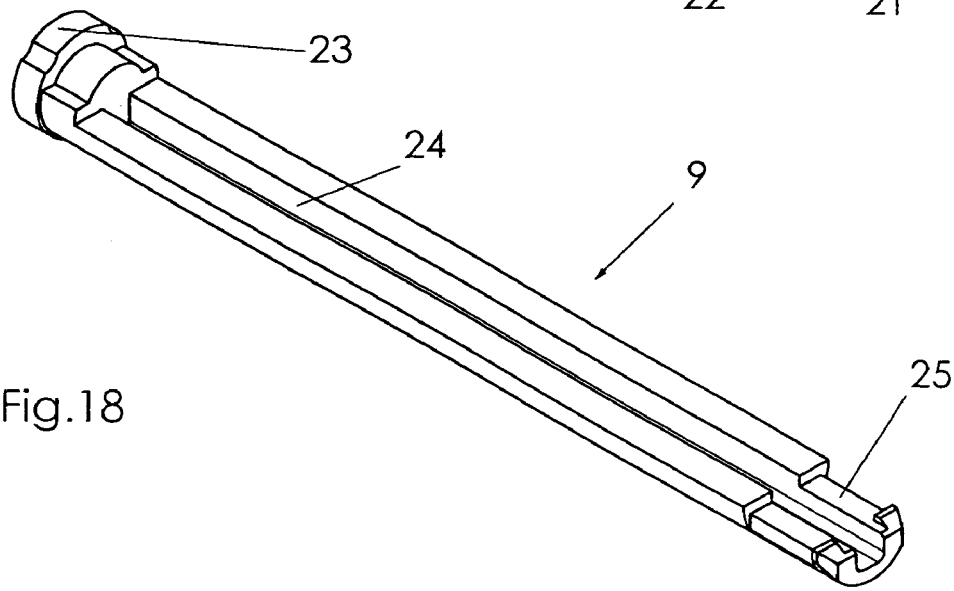
Fig.18

COUPLING DEVICE FOR AN INTEGRATED DAMPER IN A PULL-OUT SLIDE SET

FIELD OF TILE INVENTION

The invention refers to a coupling device for an integrated damping element in a pull-out slide set, according to the introductory characterizing clause of the independent claims.

BACKGROUND OF THE INVENTION

DE 198 35 466 A1, which goes back to the same applicant, shows a braking and damping device for movable cabinet components, as for example, pull-out slides on drawers. This device is already located between a movable cabinet component (drawer rail) and a stationary cabinet component (cabinet rail). A draw-in 'closing' device, as is made known from the state of technology, is likewise located there. The damper activates a braking/damping of the closing motion caused by a manual push, as well as a braking/damping of the closing motion caused by the draw-in closing device. The braking/damping is caused by braking elements, which function as friction brakes in the form of block brakes when the drawer closes. A control element is uncoupled by a driver pin, so that a spring can pull the drawer in a braked manner into the closed position. So even a drawer that closes with a high rate of speed, is braked by a correspondingly larger spreading action on the block brakes.

The disadvantage thereby is that during the opening process, the draw-in spring force, plus the force of the block spreading spring, must be overcome. The braking and/or damping characteristic is difficult to adjust in friction systems. Above all, the uniform function cannot be guaranteed for the long term.

SUMMARY OF THE INVENTION

The task of the presented invention is to further develop a braking device for movable cabinet components (for example, drawer) stemming from the state of technology as described above, so that less manual force is needed for pulling the movable cabinet component out. Also, it can be more easily adjusted and ensures a longer life span.

The features and characteristics of the independent claims serve to solve the task posed.

It is important that both a damping device and also a coupling device are between the stationary cabinet rail and the corresponding linear-movable drawer rail, so that the damping device contains at least one cylinder and in this cylinder there is at least one damped linear-movable piston rod, and the damping device is connected by one of its damping components with one of the rails and by its other respective damping component by means of the coupling device with the other respective rail, can be coupled at times during the drawer's closing and opening.

The advantage is that less manual force is needed for pulling the movable drawer components out. Also, it can be more easily adjusted and ensures a longer life span.

The preferred developments of the invention are the subject of the sub claims.

In particular, it is preferred that the cylinder part is fastened to the movable drawer rail and the piston rod is fastened to the cabinet rail and the piston rod is connected to a part of a coupling device, which works together with a stop component on the cabinet rail in a positive interlocking and releasable way.

A cylinder damper (preferably a pneumatic damper) is fastened on the drawer rail that is inserted or attached. The piston rod of the cylinder damper has a hook body, which hits within a pre-defined range before the drawer's closed position on a damper stop and so guides the damping process. In this way, the cylinder's operation and the damping media adapt to the damping characteristic, which, however, should not be the subject of the invention. The return-motion hooks are located behind the u-shaped shanks of the damping stop. The drawer rails, together with the drawer, now proceed further damped and pushes the guide component that is fastened to the drawer rail between the return-motion hooks, which are fitted together with springs, so that these are spread apart and engage behind the damper stop. The long guide wedge pushes itself further, by means of the return-motion hooks and the piston rods, deeper into the cylinder until the drawer is completely closed.

A longer guide component and a longer piston rod cause a larger damped closing range.

If the drawer, together with the drawer rails, are pulled out again, the expanded return-motion hooks hold the piston rods while the cylinder goes with the opening (pull-out) motion. At the same time, the guide wedge also goes with the opening (pull-out) motion until the pistons are completely pulled out and the guide wedge releases the return-motion hooks. These spring back and go, as the drawer is opened further, by means of the u-shaped damper stop until the drawer's final open position is attained.

When the piston rods are pulled out, there must be no noticeable resistance that must be overcome. The air or other medium flows, thereby, without resistance out into the open or into the other cylinder chamber.

In order to explain the invention, an example is described in the following, which is, however, not to be understood as restrictive, but is to assist and contribute to the better understanding of the invention. Of course, equivalent constructions and designs are included in the invention, which have the same effect or result.

BRIEF DESCRIPTION OF THE DRAWINGS

FIGS. 2 to 4 show the closing process and FIGS. 5 to 9 show the drawer's opening process;

FIG. 2: An enlarged representation, which shows the partial section of the illustrated rail system, according to FIG. 1, in the area of the integrated damping element's coupling device, in the disengaged state of the coupling device and shortly before its engagement;

FIG. 3: The rail system, according to FIG. 2, at a later time, in the engaged condition of the coupling device;

FIG. 4: The rail system, according to FIG. 3, at a later time, in the coupled and (by means of the guide wedge) engaged state of the coupling device, and at the beginning of the damped closing motion;

FIG. 5: The rail system, according to FIG. 4, at a later time in a coupled and (by means of the guide wedge) engaged state of the coupling device, and at the beginning of the damped opening motion;

FIG. 6: The rail system, according to FIG. 5, at a later time in a coupled and (by means of the guide wedge) engaged state of the coupling device, and during the damped opening motion;

FIG. 7: The rail system, according to FIG. 6, at a later time in a coupled and (by means of the guide wedge) engaged state of the coupling device, and during the damped opening motion;

FIG. 8: The rail system, according to FIG. 7, at a later time during the coupling device's disengagement and, by means of the guide wedge, the coupling device that is no longer engaged and after the conclusion of the damped opening movement;

FIG. 9: The rail system, according to FIG. 8, at a later time, in the coupling device's disengaged state;

FIG. 12: A lower view of the guide wedge, according to FIGS. 1 to 9;

FIG. 13: A side view of the guide wedge, according to FIGS. 1 to 9;

FIG. 14: A lower view of the hook body of the coupling device, according to FIGS. 1 to 11;

FIG. 15: A lower view of the hook body of the coupling device, according to FIG. 14;

FIG. 16: A lower view of the damper stop, according to FIGS. 1 to 11;

FIG. 17: A side view of the damper stop, according to FIG. 16;

FIG. 18: A perspective representation of the piston with piston rod, according to FIGS. 1 to 11.

DETAILED DESCRIPTION

Figure 1:
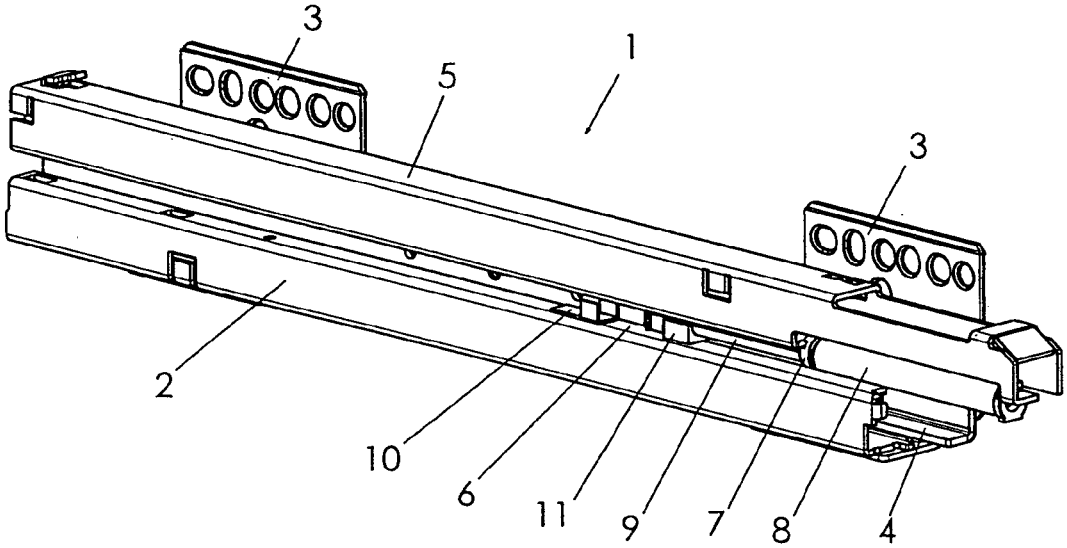
FIG. 1: A perspective representation of a rail system of the invention-related pull-out slide set, as shown in the invention, in the temporal final range of the drawer's closing.

FIG. 1 shows a rail system (1) of the invention-related pull-out slide set for movable cabinet components (especially for drawers) in a cabinet. For a drawer, generally, two such rail systems (1) are necessary for the drawer—one for the left and one for the right side—which allows the drawer to be pulled out of the cabinet in a linear fashion and allows the drawer to be pushed back in again. FIG. 1 shows a full-extension system; however, this does not restrict the invention because the invention-related damping and coupling device can also be used with partial-extension or single-extension rail systems.

The full-extension rail system (1) represented here consists of a center rail (4), which is connected by corresponding roller bearings on one side with a drawer rail (5) and is, additionally, connected linear-movable on the other side with a cabinet rail (2).

The cabinet rail (2) is, hereby, connected by two fastening angles (3) with the respective left or right cabinet wall (not shown), e.g. by a screw connection.

In the front range of the rail system (1) (in FIG. 1—right), a damping device (7) is located between the cabinet-fixed cabinet rail (2) and the relative movable drawer rail (5), as well as a partially attached coupling device (6) that works together with it.

Here, the damping device (7) has a cylinder (8) that is fixed, for instance, at the front free end of the drawer rail (5) by means of corresponding holding devices; the lengthwise damped movable piston rod (9) with the piston (23) (see FIG. 18) goes into the cylinder (8). The damping device (7) is designed as a gas (for example, air/pneumatic) damper or liquid damper (for example, hydraulic oil) and is known from the state of technology.

The coupling device (6) has a hook body (11) with return-motion hooks (12) (see FIG. 2), which hook body (11) is fastened on its free end of the piston rod (9) of the damping device (7). The hook body (11) with hooks (12) works occasionally, depending on the relative position of the rails (2, 5) together with a damper stop (10), which damper stop (10) is fastened on the cabinet rail (2).

FIG. 1 shows the components (12 and 10) of the coupling device (6) that are not engaged with each other because the drawer is not pushed far enough into the cabinet.

Figure 2:
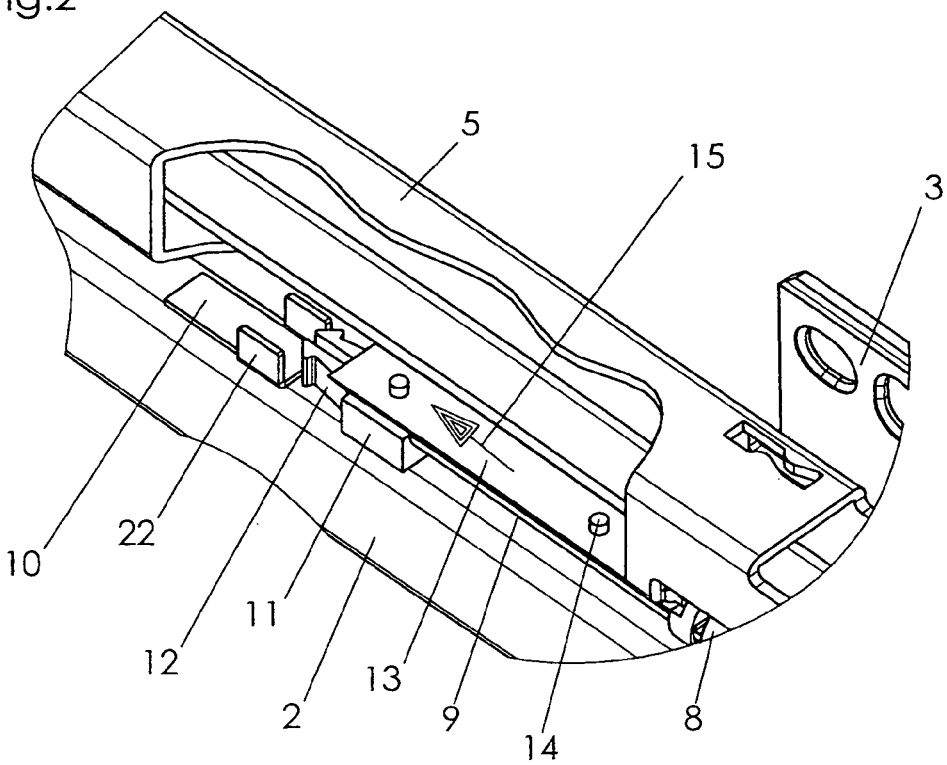
FIGS. 2 to 9: A temporal succession of the rail system's closing and opening processes, as shown in FIG. 1.

FIG. 2 shows now an enlarged representation of the area of the coupling device (6) and the damping device (7) that are in the front area of the drawer, so that the same reference symbols also designate the same construction units as shown in FIG. 1, just like in all the other FIGS. 3 to 18.

Compared to FIG. 1, the drawer rail (5) is already pushed a section further into the closing direction (15), so that the hook body (11) stands together with the hooks (12) and the coupling device's (6) stop (10) shortly before contact. The flexible springy hooks (12) are located in a basic position somewhat parallel to one another and have a smaller or, however, a somewhat larger total width than the slight distance of both vertical side tabs (22) of the stop (10), through which the hooks (12) must be guided. There is, additionally, a guide wedge (13), which is fixed firmly connected by means of pins (14) with the drawer rail (5) and, with it, the cylinder (8). This is more closely described in the following.

Figure 3:
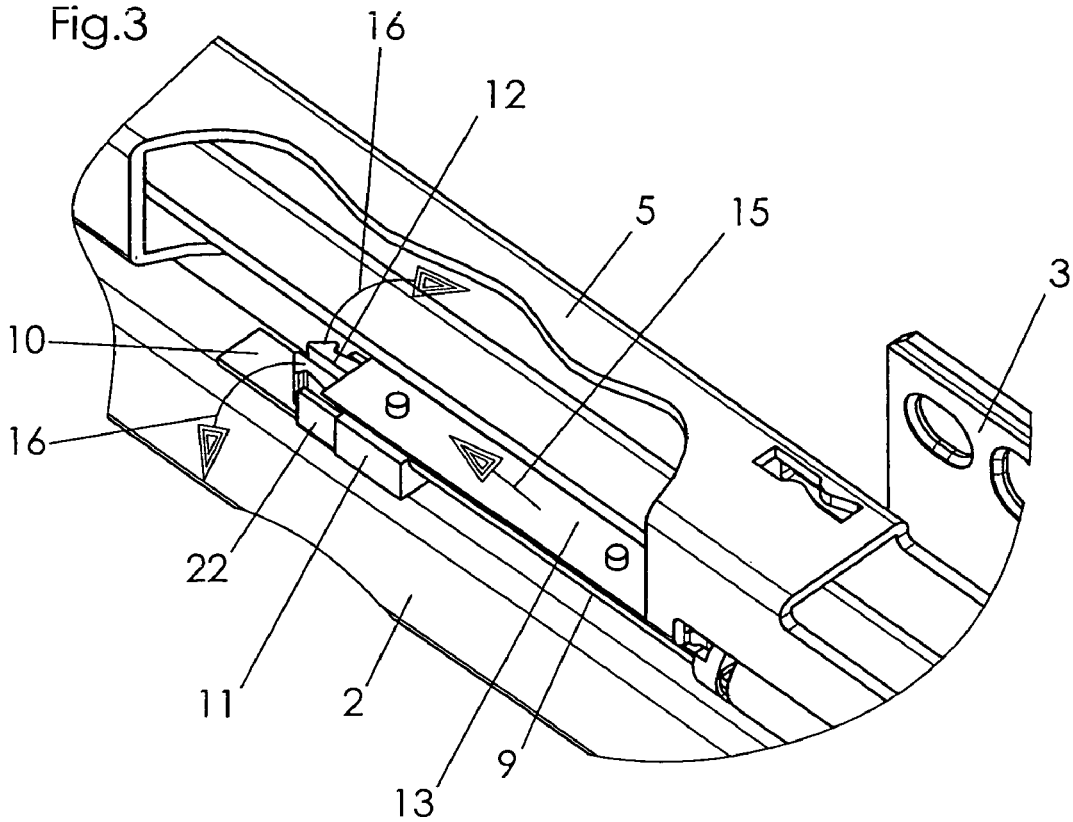

FIG. 3 shows the hook body (11) that has already come into a positive form-fitting position with the stop (10) by the further pushing of the drawer (and with it, the drawer rail [5]) by the fixed stationary cabinet rail (2) back into the cabinet. The hooks (12) are pushed (between FIG. 2 and FIG. 3) by the tabs (22) lengthwise towards the back until the front side (32) of the hook body (11) comes into contact with the outer front side (31) of the tabs (22) of the stop (10). Starting from the time a damped closing movement of the drawer takes place, the damping takes place by means of the damping device (7). The hooks (12) in FIG. 3 do not yet stand in a positive engagement with the stop (10).

When the drawer is pushed in further, both flexible springy hooks (12) are then swiveled outward by the spreading effect of the guide wedge (13) in the swiveling direction (16) that run in the gap between the hooks (12), so that the pull-out ramp (29) positively engages with the inner front side (30) and is held there firmly by the piston rod (9). So, this clamping/wedging causes an interlocking positive coupling of the piston rod (9) of the damping device (7) that is fastened on the drawer rail (5) with the firmly fixed cabinet rail (2).

Figure 4:
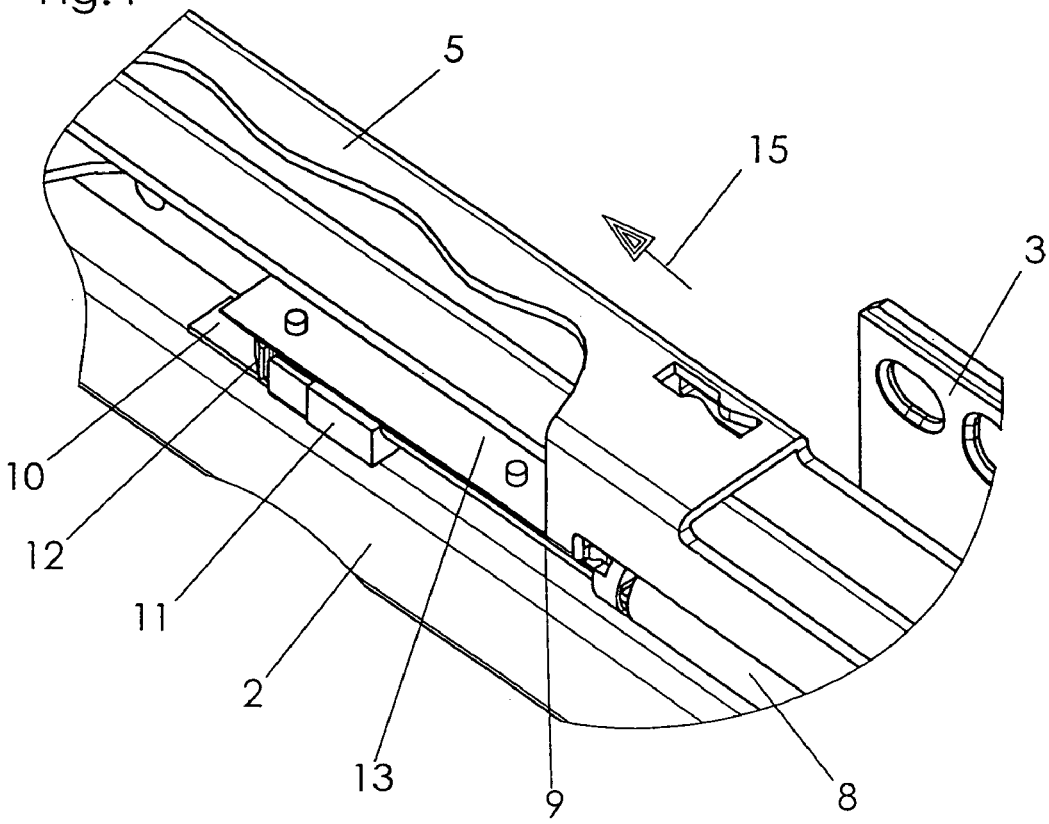

FIG. 4 shows this position after the drawer and/or the drawer rail (5) is pushed further in the closing direction (15) into the cabinet. The guide wedge (13) that is fixed on the drawer rail (5) is pushed between both hooks (12) and the tabs (22), resulting in the securing of the spreading/expansion of the hooks (12) and, with it, the clamping/wedging at the stop (10), which also stays upright up to and in the drawer's closed position. This clamping/wedging is only released again after the guide wedge (13) goes backwards out of the gap or space between the hooks (12).

Figure 5:
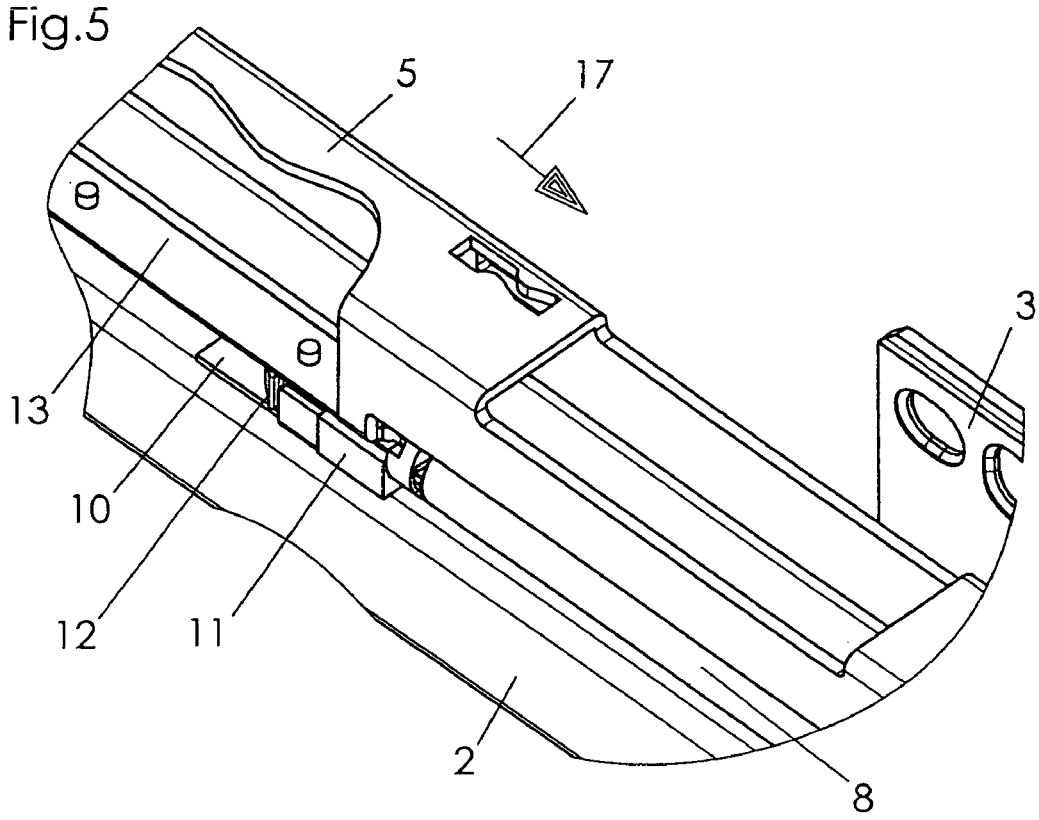

FIG. 5 shows the state of the drawer in or near the closed position, in a moment of the drawer rail's (5) opening movement in opening direction (17) against the closing direction (15) of FIGS. 2 to 4.

Figure 6:
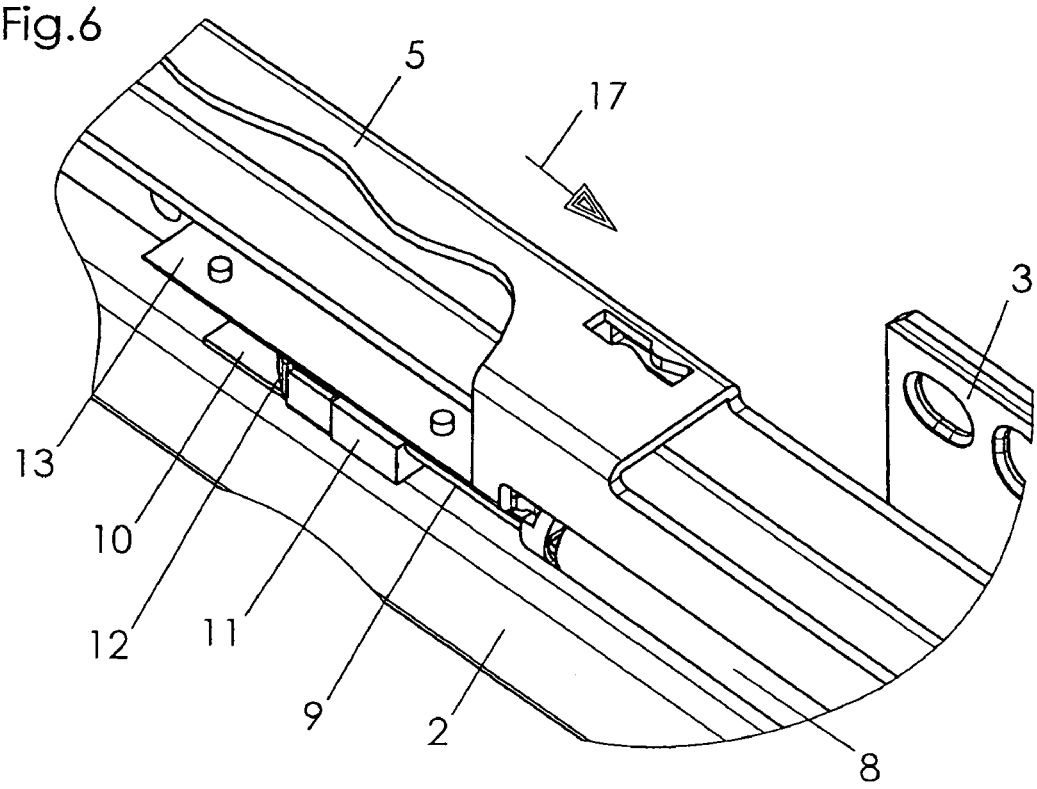

FIG. 6 shows a temporal later situation after the drawer is already pulled partially from the cabinet. The guide wedge (13) holds the hooks (12) spread outward, until it pulled through, so that it is held securely with the hooks (12) by the piston rod (9) connected by the hook body (11) to the cabinet rail (2). When the cylinder (8) on the drawer rail (5) is moved in the opening direction (17), the cylinder (8) and piston rod (9) are driven apart and this readies a later renewed damping closing process of the drawer. The manual force applied by the user to pull the cylinder (8) and piston rod (9) open (17) and apart is relatively small. In contrast, the damping force that must be used during the closing (15) process is ensured by the respective canal slide inside the cylinder (8).

Figure 7:
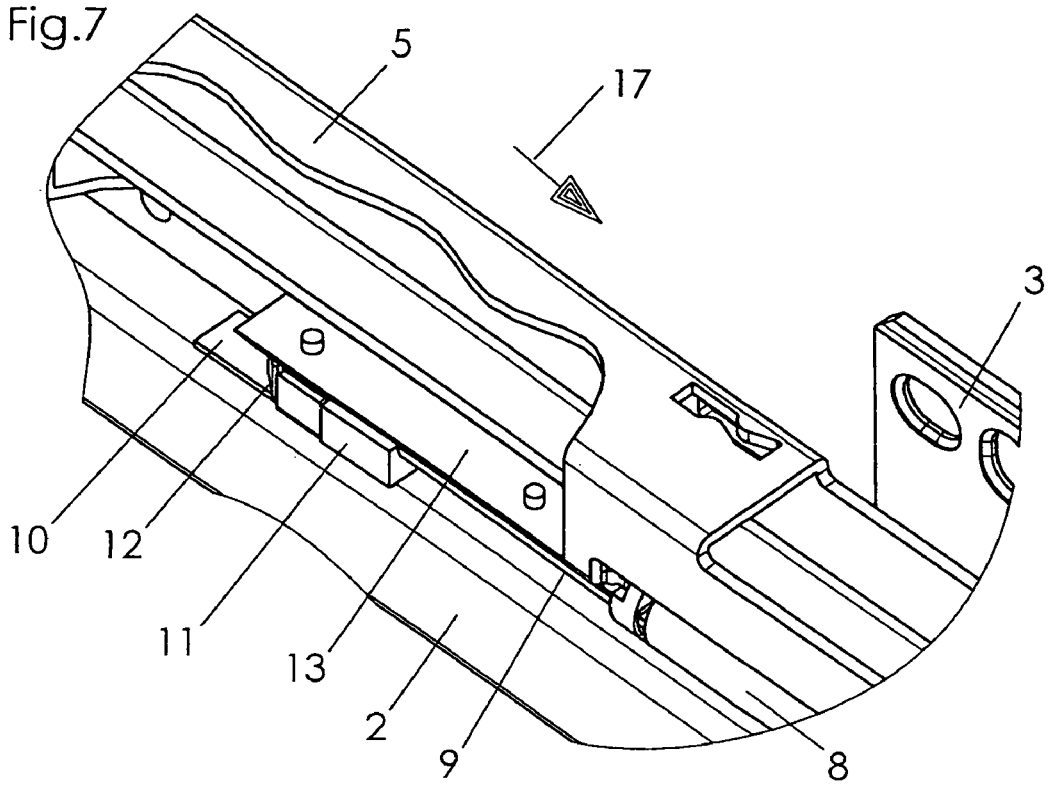

FIG. 7 shows the drawer that is pulled further away from the cabinet and, with it, the drawer rail (5) that is relative to the cabinet rail (2) is pulled further in the opening direction (17); whereby, the guide wedge (13) always holds the hooks (12) spread outward, so that the piston rod (9) is always still held firmly on the cabinet rail (2). Here the end position of the maximum relative operating distance between the cylinder (8) and the piston rod (9) is almost reached.

Figure 8:
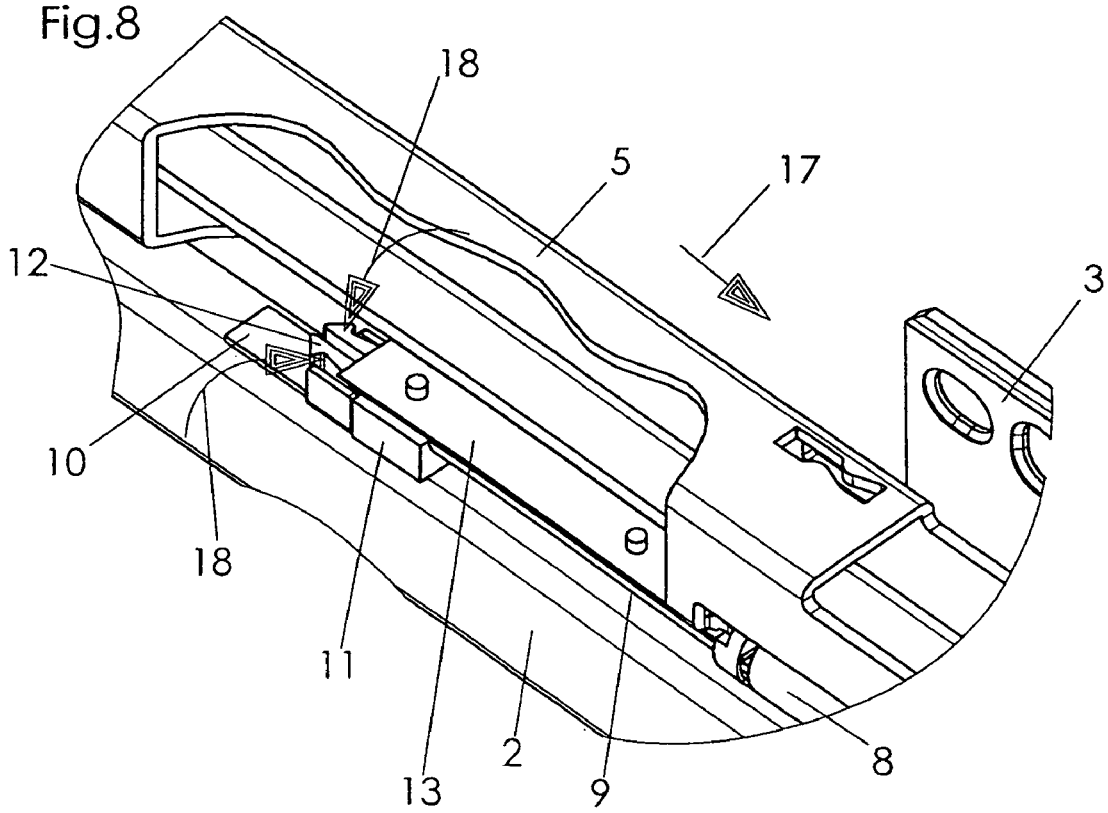

FIG. 8 shows that the guide wedge (13) is driven out of the space between the hooks (12), so that these can swivel on each other flexible and springy into their initial position in the swiveling directions (18). Pulling out the drawer further causes the hooks (12) to be pulled back through both side tabs (22) of the stop (10) and, thus, releases the coupling between the rails (2, 5).

Figure 9:
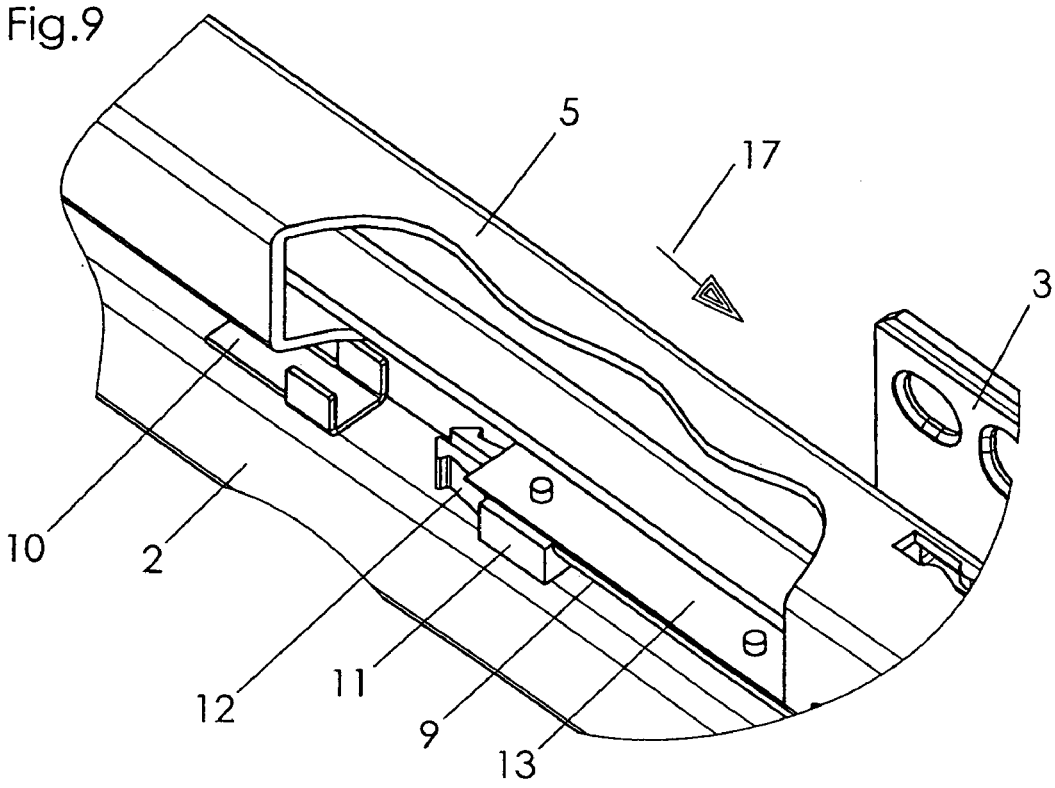

FIG. 9 shows the same state of the rail system that is shown in FIG. 2, with uncoupled rails (2, 5). The damping device (7) also only operates effectively engaged with the coupling device (6) between the rails (2, 5) and operates only during the drawer's closing process (15), but does not, or only insignificantly, operate during the drawer's opening process (17).

Figure 10:
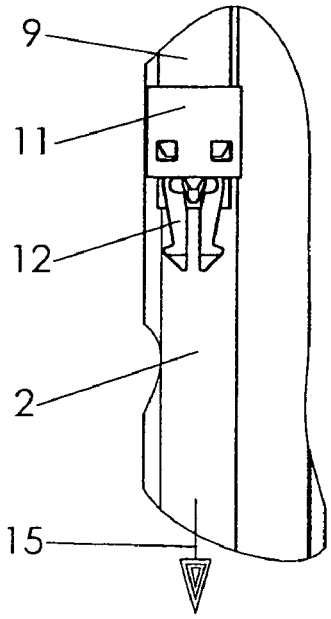
FIG. 10: A lower view of the coupling mechanism of the invention-related rail system, according to FIGS. 1 to 9, in the uncoupled state with the return-motion hooks that are not spread.
Figure 11:
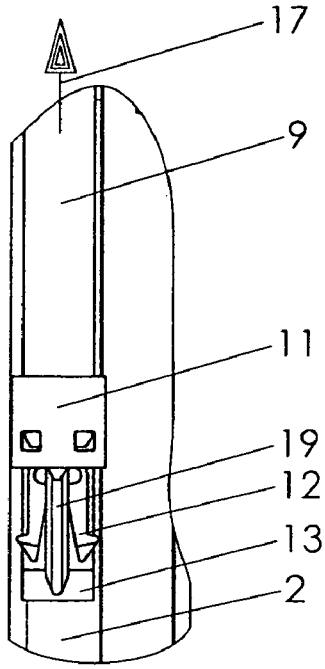
FIG. 11: A lower view of the coupling mechanism of the invention-related rail system, according to FIGS. 1 to 9, in the coupled state with the return-motion hooks that are spread by means of the guide wedge.

FIGS. 10 and 11 show a lower view of the coupling device (6) in the disengaged state (FIG. 10) and in the engaged state (FIG. 11). In the engaged state, as shown in FIG. 11, the guide ribs (19) of the guide wedge (13) drive into the space between the hooks (12) and spread the hooks securely apart at the stop (10). Releasing the hooks (12) from the engagement with the stop (10) is now possible only if the guide ribs (19) of the guide wedge (13) are pulled out again in the opening direction (17) so that it is ensured that the cylinder (8) and the piston rod (9) are pulled completely apart in the operating state for a renewed damped closing process (15).

FIGS. 12 and 13 show the guide wedge (13) in a lower view (FIG. 12) and a side view (FIG. 13). Here, the wedge-shaped lengthwise symmetrical guide ribs (19) are recognizable with both wedge surfaces (20), as well as the fastening pins (14).

FIGS. 14 and 15 represent the hook body (11) with both flexible springy return-motion hooks (12) attached on it. The return-motion hooks (12) are, thereby, represented in their basic position, in which no spring action works. A deflection in the hook's (12) spreading direction (16) away from the longitudinal center axle (27) by means of the guide ribs (19) pushing into the space between the hooks (12) causes the hook (12) to make a flexible turn around the fulcrum (26), and after receiving the guide rib (19), a flexible return spring in the return spring device (18) goes around the fulcrum (26) in the direction of the longitudinal center axle (27) back into the basic position.

FIGS. 16 and 17 represent the damper stop (10) that has a horizontal base plate (21) that lies on the cabinet rail (2). On the free drawer-outside end of the base plate (21) on the left and right of it, there is a vertical side tab (22) formed on each side. The base plate (21) and the side tabs (22) are preferably formed from a work piece, especially by the stamping-bending process.

FIG. 18 shows the piston rods (9) enlarged, which has on its front side a piston (23) with increased diameter and on the other front side has a fastening area (25) for the hook body (11). Between both front sides there extends a somewhat central slide groove (24) into which the guide ribs (19) of the guide wedge (13) can engage lengthwise-movable. The slide groove (24) breaks through the front side of the piston rod (9), with the fastening area (25) for the hook body (11), but, however, not the front side of the piston rod (9) with the piston (23).

DRAWING LEGEND

1. Rail system
2. Cabinet rail
3. Fastening angle
4. Center rail
5. Drawer rail
6. Coupling device
7. Damping device
8. Damping device's cylinder
9. Damping device's piston rod
10. Coupling device's damping stop
11. Coupling device's hook body
12. Coupling device's return-motion hooks
13. Coupling device's guide wedge
14. Guide wedge's fastening pins
15. Direction of the closing movement
16. Swiveling direction of the return-motion hook's engagement movement
17. Direction of the opening movement
18. Swiveling direction of the return-motion hook's disengagement movement
19. Guide wedge's guide ribs
20. Guide rib's wedge surface
21. Damper stop's base plate
22. Damper stop's vertical side tabs
23. Damping device's piston
24. Piston rod's slide groove for the guide wedge's guide ribs
25. Piston rod's fastening area for the hook body
26. Fulcrum
27. Longitudinal center axle
28. Inner push-in ramp
29. Outer pull-out ramp
30. Inner front side of the tab (22)
31. Outer front side of the tab (22)
32. Inner front side of the hook body (11)

What is claimed is:

1. Pull-out slide set with rail system, comprising:

at least one fixed cabinet rail;

at least one lengthwise movable drawer rail that is movable relative to the fixed cabinet rail; and a damping device and a coupling device located between the cabinet rail and the drawer rail; wherein the damping device contains at least one cylinder and at least one damped linearly movable piston rod, which is located in the cylinder, and wherein the damping device is connected with one of the cabinet rail and the drawer rail by one of the cylinder and the piston rod and is coupleable with the other one of the cabinet rail and the drawer rail by the other one of the cylinder and the piston rod by means of the coupling device wherein the coupling device has a first part having a hook body that is located on the piston rod, the hook body having at least one return-motion hook which can be moved flexibly and resiliently by the application of force of a guide wedge, and wherein the coupling device has a second part having at least one tab that is releaseably engageable with the at least one return-motion hook.

2. Pull-out slide set, according to claim 1, wherein the damping device is located in a front area of the drawer rail and operates at an end of a push-in phase of the drawer rail relative to the cabinet rail in proximity to a closed position of the drawer rail relative to the cabinet rail.

3. Pull-out slide set, according to claim 2, wherein the damping device operates essentially only in the push-in phase of the drawer.

4. Pull-out slide set, according to claim 2, wherein the damping device is designed as one of a pneumatic damper and a liquid damper.

5. Pull-out slide set, according to claim 1, wherein the coupling device is located in front areas of the cabinet rail and the drawer rail and operates at the end of a push-in phase of the drawer rail relative to the cabinet rail in proximity to a closed position of the drawer rail relative to the cabinet rail.

6. Pull-out slide set, according to claim 1, wherein the at least one cylinder is connected to the movable drawer rail, and the piston rod is connected to the first part of the coupling device, wherein the first part of the coupling device works together with the second part of the coupling device that is disposed on the cabinet rail, and wherein the first and second parts of the coupling device are positively interlockable with one another and releasable from one another.

7. Pull-out slide set, according to claim 1, wherein the guide wedge is firmly connected to the drawer rail.

8. Pull-out slide set, according to claim 1, wherein the hook body is located in a fastening area of a free end of the piston rod and the at least one return-motion hook is located on a free end of the hook body.

9. Pull-out slide set, according to claim 1, wherein the at least one return-motion hook further comprises an outer pull-out ramp which engages form-fitting with an inner front side of the at least one tab when the drawer rail is being pulled out in an opening direction between a closed position and a pre-defined opening position of the drawer rail relative to the cabinet rail.

10. Pull-out slide set, according to claim 1, wherein the guide wedge is connected firmly to the drawer rail and ensures that the at least one return-motion hook is engaged with at the least one tab when the drawer is being pulled out in an opening direction between a closed position and a pre-defined opening position.

11. Pull-out slide set with rail system, comprising:

at least one firmly fixed cabinet rail;

a lengthwise movable drawer rail that is movable relative to the cabinet rail; and a damping device and a coupling device located between the firmly fixed cabinet rail and the movable drawer rail, wherein the damping device has a cylinder and a piston rod, which cylinder of the damping device is fastened to the movable drawer rail and which piston rod is designed as a part of the coupling device, which works together form-fitting and releasable with another part of the coupling device in the form of a stop component on the cabinet rail.

12. Pull-out slide set, according to claim 11, wherein the damping device is located in a front area of the drawer rail and operates at an end of a push-in phase of the drawer rail relative to the cabinet rail in proximity to a closed position of the drawer rail relative to the cabinet rail.

13. Pull-out slide set, according to claim 12, wherein the damping device operates essentially only in the push-in phase of the drawer.

14. Pull-out slide set, according to claim 12, wherein the damping device is designed as one of a pneumatic damper and a liquid damper.

15. Pull-out slide set, according to claim 11, wherein the coupling device is located in front areas of the cabinet rail and the drawer rail and operates at the end of a push-in phase of the drawer rail relative to the cabinet rail in proximity to a closed position of the drawer rail relative to the cabinet rail.

16. Pull-out slide set, according to claim 11, wherein the cylinder is connected to the movable drawer rail, and the piston rod is connected to a first part of the coupling device, wherein the first part of the coupling device works together with a second part of the coupling device that is disposed on the cabinet rail, and wherein the first and second parts of the coupling device are positively interlockable with one another and releasable from one another.

17. Pull-out slide set, according to claim 16, wherein a hook body is located on the piston rod, the hook body having at least one return-motion hook which can be moved flexibly and resiliently by the application of force of a guide wedge, and wherein the second part of the coupling device has at least one tab that is engageable with the at least one return-motion hook.

18. Pull-out slide set, according to claim 17, wherein the hook body is located in a fastening area of a free end of the piston rod and the at least one return-motion hook is located on a free end of the hook body.

19. Pull-out slide set, according to claim 17, wherein the at least one return-motion hook further comprises an outer pull-out ramp which engages form-fitting with an inner front side of the at least one tab when the drawer rail is being pulled out in an opening direction between a closed position and a pre-defined opening position of the drawer rail relative to the cabinet rail.

20. Pull-out slide set, according to claim 17, further comprising a guide wedge that is connected firmly to the drawer rail and ensures that the at least one return-motion hook is engaged with at the least one tab when the drawer is being pulled out in an opening direction between a closed position and a pre-defined opening position.

* * * * *